US012693050B2

(12) United States Patent
Taras

(10) Patent No.: US 12,693,050 B2
(45) Date of Patent: Jul. 28, 2026

(54) HEATING, VENTILATION, AND AIR-CONDITIONING SYSTEM WITH REHEAT

(71) Applicant: Goodman Global Group, Inc., Waller, TX (US)

(72) Inventor: Michael F Taras, The Woodlands, TX (US)

(73) Assignee: Goodman Global Group, Inc., Waller, TX (US)

( * ) Notice: Subject to any disclaimer, the term of this patent is extended or adjusted under 35 U.S.C. 154(b) by 305 days.

(21) Appl. No.: 17/212,923

(22) Filed: Mar. 25, 2021

(65) Prior Publication Data

US 2021/0302073 A1 Sep. 30, 2021

Related U.S. Application Data

(60) Provisional application No. 63/002,568, filed on Mar. 31, 2020.

(51) Int. Cl.

| | |
|---|---|
| ***F25B 13/00*** | (2006.01) |
| ***F25B 41/20*** | (2021.01) |
| ***F25B 49/02*** | (2006.01) |

(52) U.S. Cl.
CPC ..... *F25B 13/00* (2013.01); *F25B 41/20* (2021.01); *F25B 49/02* (2013.01);
(Continued)

(58) Field of Classification Search
CPC ..... F25B 13/00; F25B 2700/1933; F25B 2700/1931; F25B 2600/2501;
(Continued)

(56) References Cited

U.S. PATENT DOCUMENTS

| | | | |
|---|---|---|---|
| 6,826,921 | B1 | 12/2004 | Uselton |
| 2004/0089015 | A1 | 5/2004 | Knight et al. |

(Continued)

FOREIGN PATENT DOCUMENTS

| | | | | |
|---|---|---|---|---|
| CN | 103712369 | A * | 4/2014 | ..... B60H 1/0085 |
| EP | 1437561 | A1 | 7/2004 | |

(Continued)

OTHER PUBLICATIONS

JP-2004020086-A English Translation (Year: 2004).*

(Continued)

*Primary Examiner* — Frantz F Jules
*Assistant Examiner* — Devon Moore

(57) ABSTRACT

A heating, ventilation, and air-conditioning ("HVAC") system for use with a refrigerant. The HVAC system may include a compressor, an outdoor heat exchanger positioned downstream of the compressor, a first variable expansion device positioned downstream of the outdoor heat exchanger, an indoor heat exchanger positioned downstream of the first variable expansion device and upstream of the compressor and including a reheat portion and a main portion, a second variable expansion device positioned downstream of the reheat portion of the indoor heat exchanger and upstream of the main portion of the indoor heat exchanger, a first control valve operable to selectively control the flow of the refrigerant through the reheat portion of the indoor heat exchanger and the main portion of the indoor heat exchanger, and a control system programmed to selectively operate the HVAC system in one of a first cooling mode, a second cooling mode, and a dehumidification mode.

24 Claims, 4 Drawing Sheets

(52) U.S. Cl.
CPC ..... *F25B 2313/0233* (2013.01); *F25B 2313/0253* (2013.01); *F25B 2313/02742* (2013.01); *F25B 2400/075* (2013.01); *F25B 2600/2501* (2013.01); *F25B 2700/1931* (2013.01); *F25B 2700/1933* (2013.01)

(58) Field of Classification Search
CPC ..... F25B 2400/075; F25B 2400/013; F25B 2313/0233; F25B 49/02; F25B 41/20; F25B 2700/19; F25B 2700/191
See application file for complete search history.

(56) References Cited

U.S. PATENT DOCUMENTS

| | | | | |
|---|---|---|---|---|
| 2005/0022541 | A1* | 2/2005 | Rayburn | F25B 41/20 62/176.1 |
| 2017/0016654 | A1 | 1/2017 | Shimazu | |
| 2019/0178509 | A1* | 6/2019 | Taras | F25B 13/00 |
| 2021/0180807 | A1* | 6/2021 | Taras | F25B 41/24 |

FOREIGN PATENT DOCUMENTS

| | | | | |
|---|---|---|---|---|
| EP | 3009753 | A1 * | 4/2016 | F24F 1/02 |
| JP | 2004020086 | A * | 1/2004 | F24F 3/153 |
| KR | 101429084 | B1 | 8/2014 | |
| WO | WO-03006890 | A1 * | 1/2003 | F24F 3/1405 |
| WO | WO-2009096915 | A1 * | 8/2009 | F24F 3/153 |
| WO | WO-2010005918 | A2 * | 1/2010 | F24F 3/153 |
| WO | WO-2010039385 | A2 * | 4/2010 | F24F 3/153 |
| WO | WO-2010039386 | A2 * | 4/2010 | F24F 3/153 |
| WO | WO-2020021593 | A1 * | 1/2020 | |

OTHER PUBLICATIONS

WO-2020021593-A1 English Translation (Year: 2020).*
CN-103712369-A English Translation (Year: 2014).*
International Search Report and Written Opinion dated Jul. 6, 2021 for corresponding PCT Patent Application No. PCT/US2021/024444 filed Mar. 26, 2021.

* cited by examiner

HEATING, VENTILATION, AND AIR-CONDITIONING SYSTEM WITH REHEAT

BACKGROUND

This section is intended to introduce the reader to various aspects of the art that may be related to various aspects of the presently described embodiments—to help facilitate a better understanding of various aspects of the present embodiments. Accordingly, it should be understood that these statements are to be read in this light, and not as admissions of prior art.

In general, heating, ventilation, and air-conditioning ("HVAC") systems circulate an indoor space's air over low-temperature (for cooling) or high-temperature (for heating) sources, thereby adjusting an indoor space's ambient air temperature. HVAC systems generate these low- and high-temperature sources by, among other techniques, taking advantage of a well-known physical principle: a fluid transitioning from gas to liquid releases heat, while a fluid transitioning from liquid to gas absorbs heat.

Within a typical HVAC system, a fluid refrigerant circulates through a closed loop of tubing that uses a compressor and flow-control devices to manipulate the refrigerant's flow and pressure, causing the refrigerant to cycle between the liquid and gas phases. Generally, these phase transitions occur within the HVAC system heat exchangers, which are part of the closed loop and designed to transfer heat between the circulating refrigerant and flowing ambient air. As would be expected, the heat exchanger providing heating or cooling to the climate-controlled space or structure is described adjectivally as being "indoors," and the heat exchanger transferring heat with the surrounding outdoor environment is described as being "outdoors."

The refrigerant circulating between the indoor and outdoor heat exchangers-transitioning between phases along the way-absorbs heat from one location and releases it to the other. Those in the HVAC industry describe this cycle of absorbing and releasing heat as "pumping." To cool the climate-controlled indoor space, heat is "pumped" from the indoor side to the outdoor side, and the indoor space is heated by doing the opposite, pumping heat from the outdoors to the indoors.

Additionally, in some situations it is desirable to remove moisture from the indoor environment without changing the temperature of the air. In such situations, a reheat heat exchanger is typically used to heat air that has been cooled by the evaporator. However, this increases the amount of equipment required for the HVAC system.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to an HVAC system with reheat. Utilizing a single heat exchanger having a main portion and a reheat portion, the humidity in the air can be reduced without further cooling the interior of the structure. Additionally, the single heat exchanger can be utilized as part of an evaporator when cooling or part of a condenser when heating, increasing the cooling or heating capacity of the HVAC system without requiring additional equipment.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

Embodiments of the HVAC system are described with reference to the following figures. These and other features, aspects, and advantages of certain embodiments will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, not all features of an actual implementation may be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Figure 1:
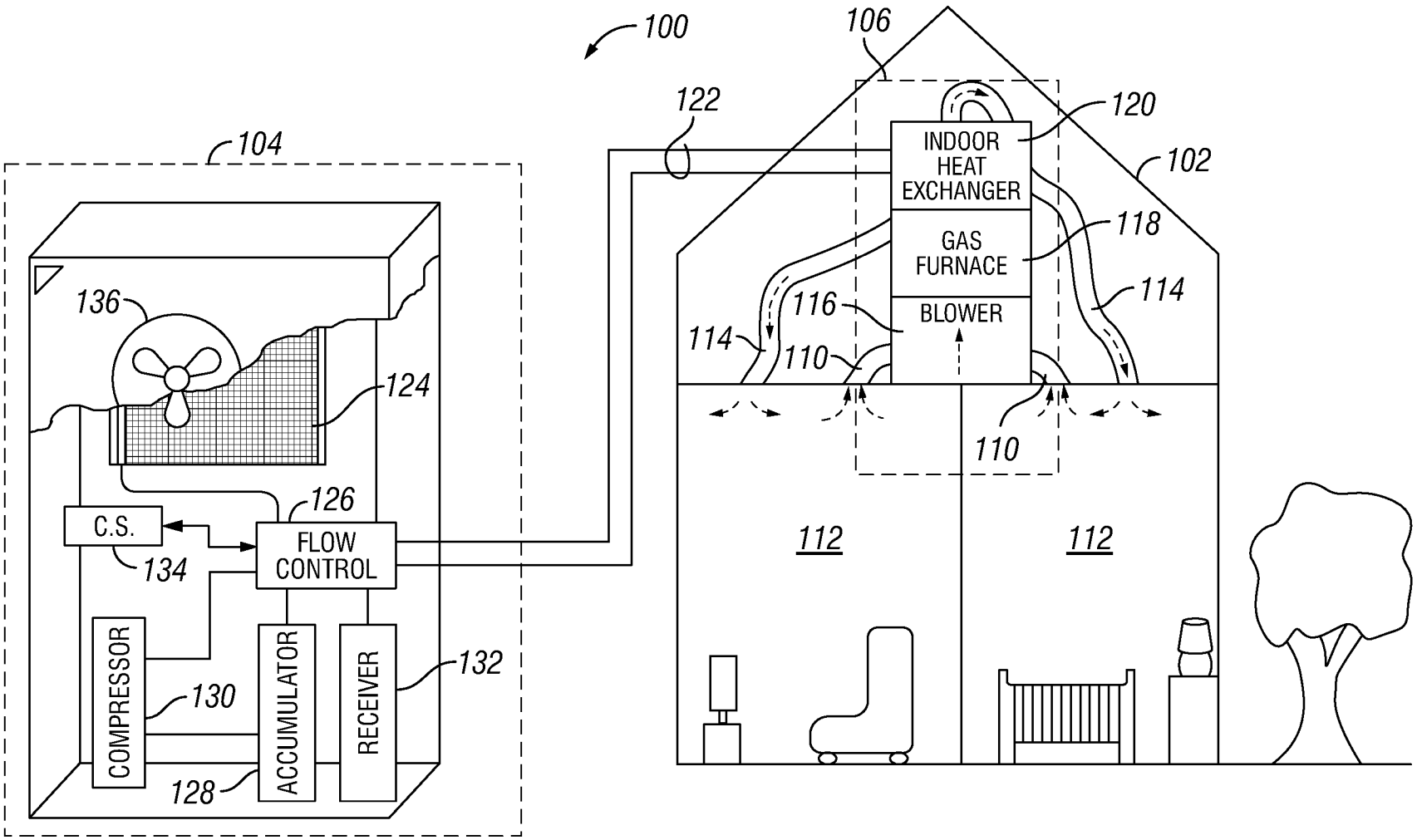
FIG. 1 is a schematic of an HVAC system, according to one or more embodiments.

Turning now the figures, FIG. 1 illustrates a schematic of an HVAC system 100 in accordance with one embodiment. As depicted, the HVAC system 100 heats and cools a residential structure 102. However, the concepts disclosed herein are applicable to numerous of heating and cooling situations, which include industrial and commercial settings.

The HVAC system 100 divides into two primary portions: The outdoor unit 104, which comprises components for transferring heat with the environment outside the structure 102; and the indoor unit 106, which comprises components for transferring heat with the air inside the structure 102. To heat or cool the illustrated structure 102, the indoor unit 106 draws ambient indoor air via returns 110, passes that air over one or more heating/cooling elements (i.e., sources of heating or cooling), and then routes that conditioned air, whether heated or cooled, back to the various climate-controlled spaces 112 through ducts or ductworks 114—which are relatively large pipes that may be rigid or flexible. A blower 116 provides the motivational force to circulate the ambient air through the returns 110 and the ducts 114. Additionally, although a split system is shown in FIG. 1, the disclosed embodiments can be equally applied to the packaged or other types of system configurations.

As shown, the HVAC system 100 is a "dual-fuel" system that has multiple heating elements, such as an electric heating element or a gas furnace 118. The gas furnace 118 located downstream (in relation to airflow) of the blower 116 combusts natural gas to produce heat in furnace tubes (not shown) that coil through the gas furnace 118. These furnace tubes act as a heating element for the ambient indoor air being pushed out of the blower 116, over the furnace tubes, and into the ducts 114. However, the gas furnace 118 is generally operated when robust heating is desired. During conventional heating and cooling operations, air from the blower 116 is routed over an indoor heat exchanger 120 and into the ductwork 114. The blower 116, the gas furnace 118, and the indoor heat exchanger 120 may be packaged as an integrated air handler unit, or those components may be modular. In other embodiments, the positions of the gas furnace 118, the indoor heat exchanger 120, and the blower 116 can be reversed or rearranged.

In at least one embodiment, the indoor heat exchanger 120 acts as a heating or cooling means that adds or removes heat from the structure, respectively, by manipulating the pressure and flow of refrigerant circulating within and between the indoor and outdoor units via refrigerant lines 122. In another embodiment, the refrigerant could be circulated to only cool (i.e., extract heat from) the structure, with heating provided independently by another source, such as, but not limited to, the gas furnace 118. In other embodiments, there may be no heating of any kind. HVAC systems 100 that use refrigerant to both heat and cool the structure 102 are often described as heat pumps, while HVAC systems 100 that use refrigerant only for cooling are commonly described as air conditioners.

Whatever the state of the indoor heat exchanger 120 (i.e., absorbing or releasing heat), the outdoor heat exchanger 124 is in the opposite state. More specifically, if heating is desired, the illustrated indoor heat exchanger 120 acts as a condenser, aiding transition of the refrigerant from a high-pressure gas to a high-pressure liquid and releasing heat in the process. The outdoor heat exchanger 124 acts as an evaporator, aiding transition of the refrigerant from a low-pressure liquid to a low-pressure gas, thereby absorbing heat from the outdoor environment. If cooling is desired, the outdoor unit 104 has flow control devices 126 that reverse the flow of the refrigerant, allowing the outdoor heat exchanger 124 to act as a condenser and allowing the indoor heat exchanger 120 to act as an evaporator. The flow control devices 126 may also act as an expander to reduce the pressure of the refrigerant flowing therethrough. In other embodiments, the expander may be a separate device located in either the outdoor unit 104 or the indoor unit 106. To facilitate the exchange of heat between the ambient indoor air and the outdoor environment in the described HVAC system 100, the respective heat exchangers 120, 124 have tubing that winds or coils through heat-exchange surfaces, to increase the surface area of contact between the tubing and the surrounding air or environment.

The illustrated outdoor unit 104 may also include an accumulator 128 that helps prevent liquid refrigerant from reaching the inlet of a compressor 130. The outdoor unit 104 may include a receiver 132 that helps to maintain sufficient refrigerant charge distribution in the HVAC system 100. The size of these components is often defined by the amount of refrigerant employed by the HVAC system 100.

The compressor 130 receives low-pressure gas refrigerant from either the indoor heat exchanger 120 if cooling is desired or from the outdoor heat exchanger 124 if heating is desired. The compressor 130 then compresses the gas refrigerant to a higher pressure based on a compressor volume ratio, namely the ratio of a discharge volume, the volume of gas outputted from the compressor 130 once compressed, to a suction volume, the volume of gas inputted into the compressor 130 before compression, and other operating conditions. In at least one embodiment, the compressor is a multi-stage compressor that can transition between at least two volume ratios depending on whether heating or cooling is desired. In other embodiments, the HVAC system 100 may be configured to only cool or only heat, the compressor 130 may be a single stage compressor having only a single volume ratio, the compressor may be a multi-stage compressor, or the HVAC system 100 may include a tandem compressor system.

The HVAC system also includes a control system 134 that controls the operation of various components of the HVAC system, such as, but not limited to the flow control devices 126 and compressor 130. The control system 134 adjusts the operation of these components based on the required heating or cooling that must be provided by the HVAC system, i.e., the load on the HVAC system 100. In some embodiments, the control system may also control the speed of a fan 136 that blows air across the heat exchanger 124.

In at least one embodiment, the control system 134 is in electronic communication with a second control system (not shown) that determines system load. In other embodiments, the control system may determine the load on the HVAC system 100 based on user input from an input device as described below, such as a desired temperature, desired temperature range, or a desired humidity, and/or data from sensors placed through the HVAC system 100. The data measured by the sensors may include, but is not limited to, the temperature within the structure 102, the humidity within the structure 102, the temperature outside of the structure 102, the humidity outside of the structure 102, and refrigerant pressure within the HVAC system.

Figure 2:
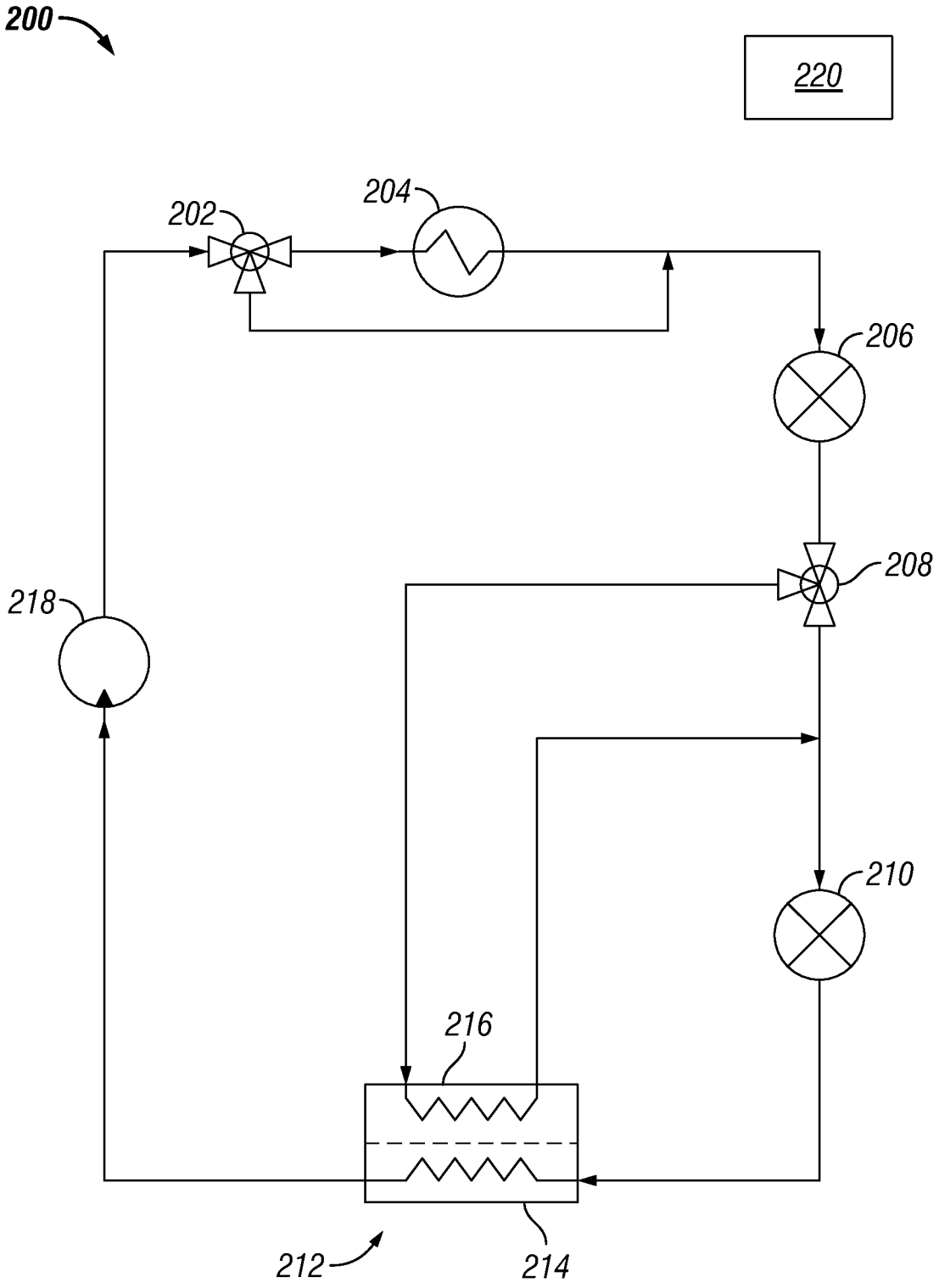
FIG. 2 is a simplified block diagram of an HVAC system in air conditioning mode, according to one or more embodiments.

Referring now to FIG. 2, FIG. 2 is a simplified block diagram of an HVAC system 200 in air conditioning mode. The HVAC system 200 includes an outdoor control valve 202, an outdoor heat exchanger 204, a first variable expansion device 206, an indoor control valve 208, a second variable expansion device 210, an indoor heat exchanger 212, which is divided into a main portion 214 and a reheat portion 216, a compressor 218, and a control system 220. In the illustrated embodiment, the control valves 202, 208 are three-way valves. In other embodiments, the three-way valves 202, 208 may each be replaced by a pair of two-way valves. Further, the indoor heat exchanger 212 is a slit-fin type heat exchanger, a heat exchanger including two separate fin packs, or any other type of heat exchanger that prevents cross-conduction between the main portion 214 and the reheat portion 216.

The control system is in electronic communication with the control valves 202, 208 and the variable expansion devices 206, 210, and is programmed as described below to select between multiple cooling modes and a dehumidification mode based on the load on the HVAC system 200 and/or user input. The dehumidification mode is used to remove moisture from the air flowing through the indoor heat exchanger and into the interior of a structure without causing a significant, i.e., more than 20%, change in the temperature of the air.

The HVAC system 200 may also include the equipment shown in FIG. 1 and function as discussed above with reference to FIG. 1. Accordingly, the function of the first heat exchanger 204, the expansion devices 206, 210, the second heat exchanger 212, and the compressor 218 will not be discussed in detail except as necessary for the understanding of the HVAC system 200 shown in FIG. 2.

In a first cooling mode, the control system 220 operates the outdoor control valve 202 to selectively control the flow of refrigerant to allow all high-pressure vapor refrigerant to pass through the outdoor heat exchanger 204, where the high-pressure vapor refrigerant sheds heat to the outdoor environment and the high-pressure vapor refrigerant is condensed into high-pressure liquid refrigerant. The high-pressure liquid refrigerant then passes through the first variable expansion device 206, which is adjusted by the control system 220 to cause little to no change in pressure. The control system 220 then operates the indoor control valve 208 to allow all high-pressure liquid refrigerant to enter the second expansion device 210, where the high-pressure liquid refrigerant is expanded into low-pressure liquid refrigerant, cooling the liquid refrigerant. The low-pressure liquid refrigerant then enters the main portion 214 of the indoor heat exchanger 212, where it absorbs heat from the indoor environment and the low-pressure liquid refrigerant is vaporized into low-pressure vapor refrigerant. The low-pressure vapor refrigerant then enters the compressor 218, where it is compressed into high-pressure vapor refrigerant, and the cycle is repeated. Since only a portion of the indoor heat exchanger 212 is utilized in the first cooling mode, it is suitable for situations where the load on the HVAC system is light and substantial cooling of the indoor environment is not required.

In a second cooling mode, the control system 220 operates the outdoor control valve 202 to allow all high-pressure vapor refrigerant to pass through the outdoor heat exchanger 204, where it is condensed into high-pressure liquid refrigerant. The high-pressure liquid refrigerant then passes through the first variable expansion device 206, which is adjusted by the control system 220 to expand the high-pressure refrigerant into a low-pressure liquid refrigerant. The control system 220 then operates the indoor control valve 208 to allow a portion or all of the low-pressure liquid refrigerant to pass through the reheat portion 216 of the indoor heat exchanger 212, based on the load on the HVAC system 200. In the reheat portion 216 of the indoor heat exchanger 212, the low-pressure liquid refrigerant absorbs heat from the indoor environment and a portion of the low-pressure liquid refrigerant may be vaporized due to the absorbed heat. The low-pressure liquid refrigerant or a low-pressure refrigerant mixture of low-pressure liquid refrigerant and low-pressure vapor refrigerant then flows through the second variable expansion device 210, which is adjusted by the control system 220 to cause little to no change in pressure.

The low-pressure liquid refrigerant or low-pressure refrigerant mixture then enters the main portion 214 of the indoor heat exchanger 212, where it is fully vaporized into low-pressure vapor refrigerant. The low-pressure vapor refrigerant then enters the compressor 218, where it is compressed into high-pressure vapor refrigerant, and the cycle is repeated. Since the second cooling mode utilizes the entire indoor heat exchanger 212 for cooling, it offers additional cooling when compared to the first cooling mode. Therefore, this mode would be used when there is high load on the HVAC system 200 and the first cooling mode is not sufficient to meet the cooling requirements. Further, controlling the amount of low-pressure liquid refrigerant that flows through the reheat portion 216 of the indoor heat exchanger 212 allows for fine-tuning of the cooling provided by the HVAC system 200.

In the dehumidification mode, the control system 220 operates the outdoor control valve 202 to allow all high-pressure vapor refrigerant to pass through the outdoor heat exchanger 204, to allow all of the refrigerant to bypass the outdoor heat exchanger 204, or to allow a portion of the refrigerant to bypass the outdoor heat exchanger 204 and allow the remainder of the refrigerant to pass through the outdoor heat exchanger 204, based on the indoor and outdoor environmental conditions and/or the desired reduction in humidity indoors. Any high-pressure vapor refrigerant passing through the outdoor heat exchanger 204 is condensed into high-pressure liquid refrigerant. The high-pressure liquid refrigerant, the high-pressure refrigerant mixture, or the high-pressure vapor refrigerant then passes through the first variable expansion device 206, which is adjusted by the control system 220 to cause little to no change in pressure. In other embodiments, the first variable expansion device 206 may expand the high-pressure liquid refrigerant into an intermediate-pressure liquid refrigerant to slightly cool the liquid refrigerant based on the indoor and outdoor environmental conditions and/or the desired reduction in humidity indoors.

The control system 220 then operates the indoor control valve 208 to allow a portion or all of the high-pressure liquid refrigerant, high-pressure refrigerant mixture, high-pressure vapor refrigerant, or intermediate-pressure liquid refrigerant to pass through the reheat portion 216 of the indoor heat exchanger 212, where the high-pressure liquid refrigerant sheds heat to the air passing through the reheat portion 216 of the indoor heat exchanger 212 and any remaining high-pressure vapor refrigerant is condensed. The control system 220 determines whether a portion or all of the high-pressure liquid refrigerant, high-pressure refrigerant mixture, high-pressure vapor refrigerant, or intermediate-pressure liquid refrigerant passes through the reheat portion 216 of the indoor heat exchanger 212 based on the presence of high-pressure vapor refrigerant remaining after passing through the outdoor heat exchanger 204, the actual indoor temperature, the desired indoor temperature, the outdoor temperature, and/or temperature of the air passing through the main portion 214 of the indoor heat exchanger 212. The high-pressure liquid refrigerant or intermediate-pressure liquid refrigerant then enters the second expansion device 210, where the high-pressure liquid refrigerant or intermediate-pressure liquid refrigerant is expanded into low-pressure liquid refrigerant. The low-pressure liquid refrigerant then enters the main portion 214 of the indoor heat exchanger 212, where it is evaporated into low-pressure vapor refrigerant. The low-pressure vapor refrigerant then enters the compressor 218, where it is compressed into high-pressure vapor refrigerant, and the cycle is repeated.

During dehumidification, the air passing over the indoor heat exchanger 212 is cooled by the main portion 214 of the indoor heat exchanger 212, reducing the amount of moisture in the air. The same air is then heated when passing through the reheat portion 216 of the indoor heat exchanger 212, resulting in air that contains less moisture without a significant change in the temperature of the air. In another embodiment, a portion of the air passing over the indoor heat exchanger 212 is cooled by the main portion 214 of the indoor heat exchanger 212, reducing the amount of moisture in the air. At the same time, the remaining air is heated when passing through the reheat portion of the indoor heat exchanger 212. The two airstreams are combined after passing through the indoor heat exchanger 212. The dehumidification mode would be used when cooling is not required of the HVAC system 200, but the air within a structure has a higher than desirable moisture level. However, the HVAC system 200 can provide slight heating or cooling while in dehumidification mode by adjusting the indoor control valve 208 to let more or less of the high-pressure liquid refrigerant, high-pressure refrigerant mixture, high-pressure vapor refrigerant, or intermediate-pressure liquid refrigerant to pass through the reheat portion 216 of the indoor heat exchanger 212.

Figure 3:
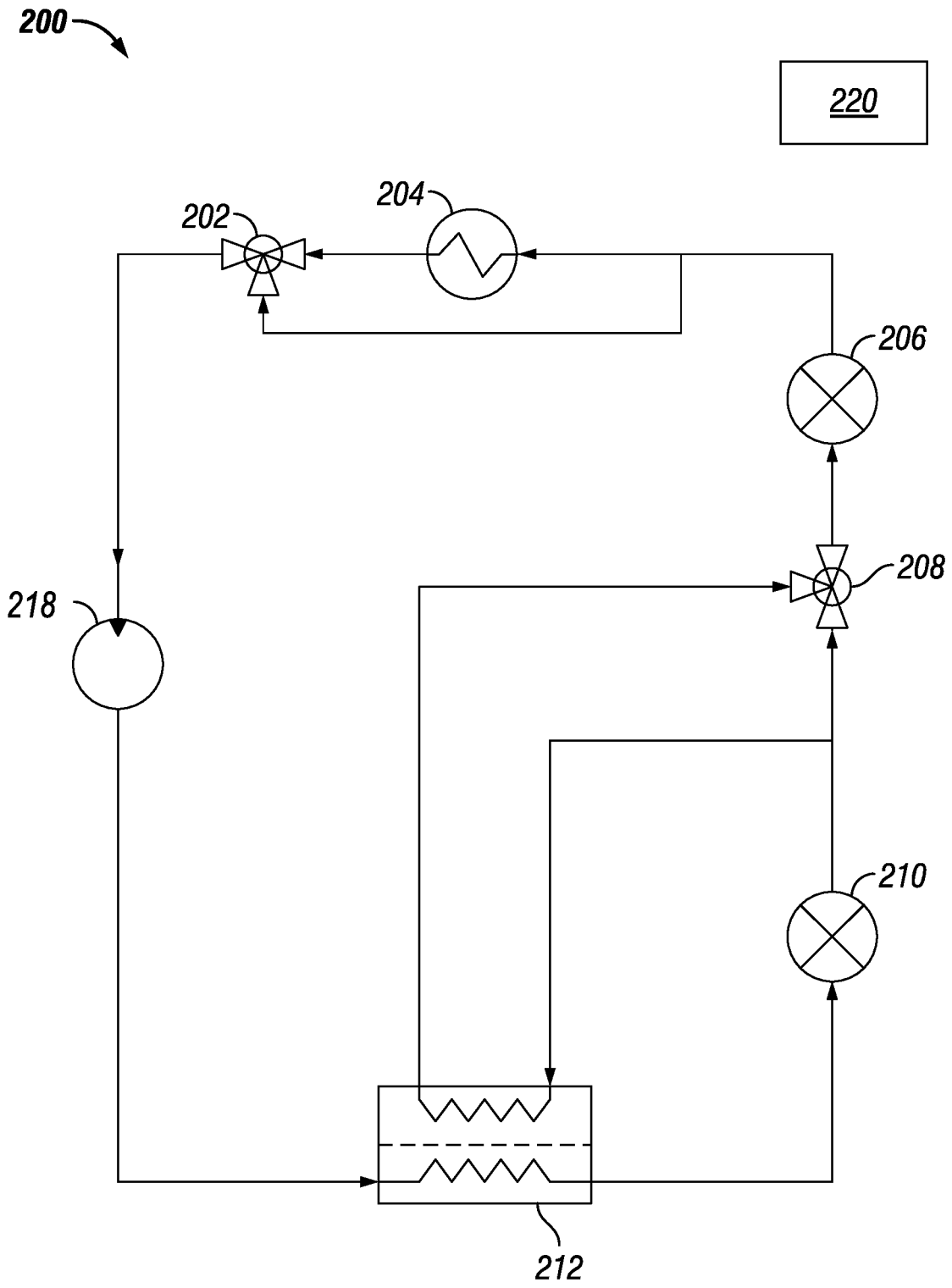
FIG. 3 is a simplified block diagram of the HVAC system of FIG. 2 in heat pump mode.

Referring now to FIG. 3, FIG. 3 is a simplified block diagram of the HVAC system 200 of FIG. 2 in heat pump mode. In heat pump mode, the control system is programmed as described below to select between two heating modes based on the load on the HVAC system 200 and/or user input. Additionally, although FIG. 3 depicts a second variable expansion device 210, this device is adjusted to cause little to no change in pressure during operation of the HVAC system 200 in heat pump mode, as described below. Accordingly, in some embodiments, it may be omitted.

In a first heating mode, high-pressure vapor refrigerant passes through the main portion 214 of the indoor heat exchanger 212, where it is condensed into high-pressure liquid refrigerant. The high-pressure liquid refrigerant then passes through the second variable expansion device 210, which is adjusted by the control system 220 to cause little to no change in pressure. The control system 220 then operates the indoor control valve 208 to allow all high-pressure liquid refrigerant to enter the first expansion device 206 without entering the reheat portion 216 of the indoor heat exchanger 212, where the high-pressure liquid refrigerant is expanded into low-pressure liquid refrigerant. The low-pressure liquid refrigerant then enters the outdoor heat exchanger 204, where it is evaporated into low-pressure vapor refrigerant. The control system 220 then operates the outdoor control valve 202 to allow all low-pressure vapor refrigerant to enter the compressor 218, where it is compressed into high-pressure vapor refrigerant, and the cycle is repeated. Since only a portion of the indoor heat exchanger 212 is utilized in the first heating mode, it is suitable for situations where the load on the HVAC system is light and substantial cooling of the indoor environment is not required.

In a second heating mode, high-pressure vapor refrigerant passes through the main portion 214 of the indoor heat exchanger 212, where it is at least partially condensed into high-pressure liquid refrigerant. The high-pressure liquid refrigerant or high-pressure refrigerant mixture then passes through the second variable expansion device 210, which is adjusted by the control system 220 to cause little to no change in pressure. The control system 220 then operates the indoor control valve 208 to allow a portion or all of the high-pressure liquid refrigerant or high-pressure refrigerant mixture to pass through the reheat portion 216 of the indoor heat exchanger 212, based on the load on the HVAC system 200. In the reheat portion 216 of the indoor heat exchanger, additional heat is shed to the air flowing over the indoor heat exchanger 212 and any remaining high-pressure vapor refrigerant is condensed into high-pressure liquid refrigerant. The high-pressure liquid refrigerant then enters the first expansion device 206, where the high-pressure liquid refrigerant is expanded into low-pressure liquid refrigerant.

The low-pressure liquid refrigerant then enters the outdoor heat exchanger 204, where it is evaporated into low-pressure vapor refrigerant. The control system 220 then operates the outdoor control valve 202 to allow all low-pressure vapor refrigerant to enter the compressor 218, where it is compressed into high-pressure vapor refrigerant, and the cycle is repeated. Since the second heating mode utilizes the entire indoor heat exchanger 212 for heating, it offers additional heating when compared to the first cooling mode. Therefore, this mode would be used when there is high load on the HVAC system and the first heating mode is not sufficient to meet the heating requirements. Further, controlling the amount of the high-pressure liquid refrigerant or high-pressure refrigerant mixture that flows through the reheat portion 216 of the indoor heat exchanger 212 allows for fine-tuning of the heating provided by the HVAC system 200.

Figure 4:
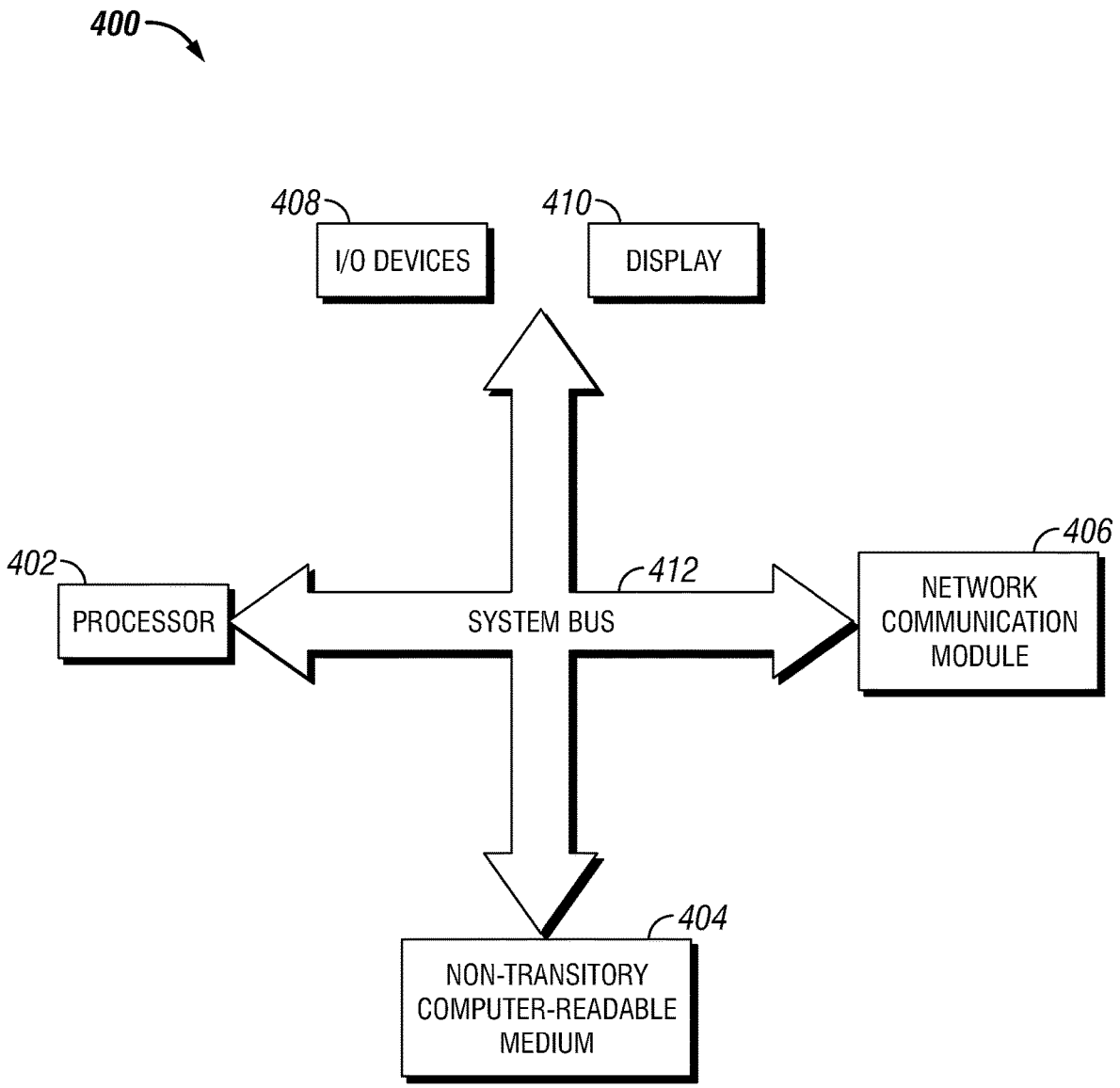
FIG. 4 is a block diagram of a controller, according to one or more embodiments.

Turning now to FIG. 4, FIG. 4 is a block diagram of a control system 400 that can be used to control the control valves and variable expansion devices, as described above with reference to FIGS. 2 and 3. The control system 400 includes at least one processor 402, a non-transitory computer readable medium 404, an optional network communication module 406, optional input/output devices 408, and an optional display 410 all interconnected via a system bus 412. In at least one embodiment, the input/output device 408 and the display 410 may be combined into a single device, such as a touch-screen display. Further, the display 410 may also include a temperature sensor that monitors the temperature within a structure. Software instructions executable by the processor 402 for implementing software instructions stored within the control system 400 in accordance with the illustrative embodiments described herein, may be stored in the non-transitory computer readable medium 404 or some other non-transitory computer-readable medium.

Although not explicitly shown in FIG. 4, it will be recognized that the control system 400 may be connected to one or more public and/or private networks via appropriate network connections. It will also be recognized that software instructions may also be loaded into the non-transitory computer readable medium 404 from an appropriate storage media or via wired or wireless means.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims. For example, certain embodiments disclosed here envisage usage with a powered fan rather than an inducer fan, or no fan at all. Moreover, the rotating equipment (e.g., motors) and valves disclosed herein are envisaged as being operable at specified speeds or variable speeds through inverter circuitry, for example. Moreover, the internal and external communication of the furnace may be accomplished through wired and or wireless communications, including known communication protocols, Wi-Fi, 802.11(x), Bluetooth, to name just a few.

What is claimed is:

1. A heating, ventilation, and air-conditioning ("HVAC") system for use with a refrigerant, the HVAC system comprising:

a compressor operable to compress the refrigerant;

an outdoor heat exchanger positioned downstream of the compressor and configured to condense the refrigerant;

a first variable expansion device positioned downstream of the outdoor heat exchanger and operable to change a pressure of the refrigerant flowing therethrough;

a single indoor heat exchanger positioned downstream of the first variable expansion device and upstream of the compressor, comprising a reheat portion downstream of the first variable expansion device and a main portion, and configured to vaporize low-pressure refrigerant;

a second variable expansion device positioned downstream of the reheat portion of the indoor heat exchanger and upstream of the main portion of the indoor heat exchanger, the second variable expansion device operable to change a pressure of the refrigerant flowing therethrough;

an indoor control valve operable to selectively control the flow of the refrigerant through the reheat portion of the indoor heat exchanger and the main portion of the indoor heat exchanger; and a control system in electronic communication with the first variable expansion device, the second variable expansion device, and the indoor control valve, the control system comprising a processor programmed to adjust the change in pressure due to the first variable expansion device, adjust the change in pressure due to the second variable expansion device, and operate the indoor control valve to selectively operate the HVAC system between a first cooling mode wherein no refrigerant flows through the reheat portion of the indoor heat exchanger, a second cooling mode wherein the pressure of the refrigerant flowing through the first variable expansion device is decreased and at least a portion of the decreased pressure refrigerant flows through the reheat portion of the indoor heat exchanger where the refrigerant absorbs heat so as to provide additional cooling compared to the first cooling mode, and a dehumidification mode.

2. The HVAC system of claim 1, wherein the reheat portion is configured to vaporize the refrigerant expanded in the first variable expansion device and the main portion is configured to vaporize refrigerant expanded in at least one of the first variable expansion device or the second variable expansion device.

3. The HVAC system of claim 1, wherein the control system is further programmed to adjust the change in pressure due to the first variable expansion device, adjust the change in pressure due to the second variable expansion device, and operate the indoor control valve based on at least one of the mode of the HVAC system or a load on the HVAC system.

4. The HVAC system of claim 1, wherein the control system further comprises an input device and the control system is further programmed to adjust the change in pressure due to the first variable expansion device, adjust the change in pressure due to the second variable expansion device, and operate the indoor control valve based on a user input from the input device.

5. The HVAC system of claim 1, further comprising an outdoor control valve positioned downstream of the compressor and upstream of the outdoor heat exchanger, the outdoor control valve operable to selectively control flow of the refrigerant through the outdoor heat exchanger and flow of the refrigerant that bypasses the outdoor heat exchanger.

6. The HVAC system of claim 3, wherein the control system is further programmed to operate the indoor control valve to force refrigerant to bypass the reheat portion, to force refrigerant to flow through the reheat portion, or to allow a first portion of refrigerant to flow through the reheat portion and a second portion of refrigerant to bypass the reheat portion.

7. The HVAC system of claim 4, wherein the control system is further programmed to operate the indoor control valve to force refrigerant to bypass the reheat portion, to force refrigerant to flow through the reheat portion, or to allow a first portion of refrigerant to flow through the reheat portion and a second portion of refrigerant to bypass the reheat portion.

8. The HVAC system of claim 5, wherein the control system is further programmed to adjust the change in pressure due to the first variable expansion device, adjust the change in pressure due to the second variable expansion device, operate the indoor control valve, and operate the outdoor control valve based on at least one of the mode of the HVAC system or a load on the HVAC system.

9. The HVAC system of claim 5, wherein the control system further comprises an input device and the control system is further programmed to adjust the change in pressure due to the first variable expansion device, adjust the change in pressure due to the second variable expansion device, operate the indoor control valve, and operate the outdoor control valve based on a user input from the input device.

10. The HVAC system of claim 8, wherein the control system is in electronic communication with the outdoor control valve and further programmed to operate the outdoor control valve to force refrigerant to bypass the outdoor heat exchanger, to force refrigerant to flow through the outdoor heat exchanger, or to allow a first portion of refrigerant to flow through the outdoor heat exchanger and a second portion of refrigerant to bypass the outdoor heat exchanger.

11. The HVAC system of claim 9, wherein the control system is in electronic communication with the outdoor control valve and further programmed to operate the outdoor control valve to force refrigerant to bypass the outdoor heat exchanger, to force refrigerant to flow through the outdoor heat exchanger, or to allow a first portion of refrigerant to flow through the outdoor heat exchanger and a second portion of refrigerant to bypass the outdoor heat exchanger.

12. An HVAC system for use with a refrigerant, the HVAC system comprising:

a compressor operable to compress the refrigerant;

an indoor heat exchanger positioned downstream of the compressor, comprising a reheat portion and a main portion, and configured to condense the refrigerant;

an expansion device positioned downstream of the indoor heat exchanger and operable to reduce a pressure of the refrigerant flowing therethrough into a low-pressure refrigerant;

outdoor heat exchanger positioned downstream of the expansion device and upstream of the compressor and configured to vaporize the low-pressure refrigerant;

an indoor control valve operable to selectively control only a selected portion of the flow of the refrigerant through the reheat portion of the indoor heat exchanger; and a control system in electronic communication with the indoor control valve, the control system comprising a processor programmed to operate the indoor control valve and the indoor control valve to selectively operate the HVAC system between one of a first heating mode wherein refrigerant flows through the main portion and no refrigerant flows through the reheat portion and a second heating mode wherein refrigerant flows through the main portion and only the selected portion of the refrigerant flows through the reheat portion, unexpanded, to provide additional heating compared to the first heating mode.

13. The HVAC system of claim 12, wherein the control system is further programmed to operate the indoor control valve based on at least one of the mode of the HVAC system or a load on the HVAC system.

14. The HVAC system of claim 12, wherein the control system further comprises an input device and the control system is further programmed to operate the indoor control valve based on a user input from the input device.

15. The HVAC system of claim 13, wherein the control system is programmed to operate the indoor control valve between a first position that forces all of the flow of the refrigerant to bypass the reheat portion, a second position that forces all of the flow of the refrigerant to flow through the reheat portion, and a position between the first position and second position to allow only a portion of the flow of the refrigerant to flow through the reheat portion.

16. The HVAC system of claim 14, wherein the control system is programmed to operate the indoor control valve between a first position that forces refrigerant to bypass the reheat portion, a second position that forces refrigerant to flow through the reheat portion, and a position between the first position and second position to allow a first portion of refrigerant to flow through the reheat portion and a second portion of refrigerant to bypass the reheat portion.

17. A method of operating an HVAC system, the method comprising:

compressing a low-pressure vapor refrigerant with a compressor into a high-pressure vapor refrigerant; then condensing at least a portion of the high-pressure vapor refrigerant into a high-pressure liquid refrigerant with an outdoor heat exchanger; then in a first cooling mode:

flowing the refrigerant through a first expansion device without adjusting the pressure of the refrigerant; then operating an indoor control valve so that no refrigerant flows through a reheat portion of an indoor heat exchanger; then expanding the refrigerant to a low-pressure liquid refrigerant with a second expansion device; and then vaporizing the low-pressure liquid refrigerant from the second expansion device with a main portion of the indoor heat exchanger;

in a second cooling mode:

expanding the refrigerant to a low-pressure liquid refrigerant with the first expansion device; then operating the indoor control valve to flow an amount of the refrigerant through the reheat portion of the indoor heat exchanger; then flowing the refrigerant through a second expansion device without adjusting the pressure of the refrigerant; and then vaporizing the low-pressure liquid refrigerant from the second expansion device with a main portion of the indoor heat exchanger; and in a dehumidification mode:

flowing the refrigerant through the first expansion device without adjusting the pressure of the refrigerant; then operating the indoor control valve to flow a first selected amount of the refrigerant through the reheat portion of the indoor heat exchanger and the remaining amount of the refrigerant does not flow through the reheat portion; then expanding the refrigerant to a low-pressure liquid refrigerant with the second expansion device; and then vaporizing the low-pressure liquid refrigerant from the first expansion device with a main portion of the indoor heat exchanger.

18. The method of claim 17, further comprising:

flowing a first portion of air across the main portion of the indoor heat exchanger to cool and reduce humidity in the first portion of the air while flowing a second portion of air over the reheat portion of the indoor heat exchanger to heat the second portion of the air; and then combining the first portion of the air and the second portion of the air such that the air flows across the indoor heat exchanger without significantly changing a temperature of the air.

19. The method of claim 17, further comprising:

flowing air across the main portion of the indoor heat exchanger to cool the air and reduce humidity in the air; and then flowing the air across the reheat portion of the indoor heat exchanger to heat the air such that the air flows across the indoor heat exchanger without significantly changing a temperature of the air.

20. The method of claim 17, wherein operating the indoor control valve comprises operating the indoor control valve to flow all of the refrigerant through the reheat portion of the indoor heat exchanger.

21. The method of claim 17, further comprising adjusting the first expansion device to expand the refrigerant to an intermediate-pressure liquid refrigerant at a higher pressure than the low-pressure liquid refrigerant, wherein:

operating the indoor control valve comprises operating the indoor control valve to flow at least a portion of the intermediate-pressure liquid refrigerant through the reheat portion of the indoor heat exchanger; and expanding the refrigerant with the second expansion device comprises expanding the intermediate-pressure liquid refrigerant to the low-pressure liquid refrigerant.

22. The method of claim 17, wherein the amount of the refrigerant flowed through the reheat portion of the indoor heat exchanger is based on a load on the HVAC system.

23. The method of claim 17, wherein the amount of the refrigerant flowed through the reheat portion of the indoor heat exchanger is based on a user input into an input device.

24. The method of claim 17, further comprising:

operating an outdoor control valve to allow at least a portion of the high-pressure vapor refrigerant to bypass the outdoor heat exchanger; and then condensing the portion of the high-pressure vapor refrigerant bypassing the outdoor heat exchanger into the high-pressure liquid refrigerant with the reheat portion of the indoor heat exchanger, wherein operating the indoor control valve comprises operating the indoor control valve to flow all of the refrigerant through the reheat portion of the indoor heat exchanger.

* * * * *